United States Patent [19]

Shields et al.

[11] Patent Number: 4,520,635

[45] Date of Patent: Jun. 4, 1985

[54] CUSHION FOOT SOCK

[75] Inventors: Harper Shields; Roger D. Lineberry, both of Burlington, N.C.

[73] Assignee: Kayser-Roth Hosiery, Inc., Burlington, N.C.

[21] Appl. No.: 614,775

[22] Filed: May 29, 1984

[51] Int. Cl.[3] ..... A41B 11/02; D04B 9/46

[52] U.S. Cl. ..... 66/185; 2/239

[58] Field of Search ..... 2/239, 240, 241; 66/202, 178 R, 185

[56] References Cited

U.S. PATENT DOCUMENTS

| | | | |
|---|---|---|---|
| 2,375,684 | 5/1945 | Page | 66/185 |
| 2,435,770 | 2/1948 | Clarke | 66/185 |
| 4,057,981 | 11/1977 | Rumac | 2/239 X |
| 4,255,819 | 3/1981 | Klingspor | 2/239 |
| 4,255,949 | 3/1981 | Thorneburg | 2/239 X |
| 4,277,959 | 7/1981 | Thorneburg | 2/239 X |
| 4,341,096 | 7/1982 | Safrit et al. | 23/239 X |
| 4,422,307 | 12/1983 | Thorneburg | 66/202 X |

*Primary Examiner*—Louis K. Rimrodt

*Attorney, Agent, or Firm*—Bell, Seltzer, Park & Gibson

[57] ABSTRACT

The high-splice area, heel, instep, sole ring-toe area, and toe of the present sock includes a heavy wool yarn knit in plated relationship with body yarn so that the wool yarn is exposed on the outside of these areas of the sock to provide a soft and fuzzy appearance thereto. The wool yarn also forms inwardly extending terry loops in these areas of the sock to provide a "cushion foot" and good moisture absorbency to the lower portion of the foot of the sock. Elastic yarn is incorporated in spaced-apart wales and floats inside of multiple wales to form mock ribs in the leg and instep while the elastic yarn is incorporated in alternate single wales of alternate single courses and in intervening single wales of intervening single courses of the high-splice area and sole, and ring-toe area to provide stretchability and firm support so that these areas are maintained in close engagement with the lower portion of the foot of the wearer.

10 Claims, 3 Drawing Figures

CUSHION FOOT SOCK

FIELD OF THE INVENTION

This invention relates generally to a cushion foot sock and more particularly to such a sock in which the leg and instep of the sock has an elastic yarn incorporated therein to form a mock rib, and with a heavy wool yarn knit in and forming inwardly extending terry loops and being exposed on the outside of the high-splice area, heel, sole and toe to provide a heavy cushion and soft fuzzy appearance thereto.

BACKGROUND OF THE INVENTION

It is generally known to form terry loops extending inwardly in the high-splice area, heel, sole and toe of a sock to provide a "cushion foot" in the sock. Examples of such socks are illustrated in U.S. Pat. Nos. 2,375,684; 2,421,817; and 2,435,770. However, this known type of "cushion foot" sock has the same general outer appearance in both the terry loop areas as well as in the adjacent areas without terry loops because the yarn forming the terry loops is usually of about the same size and type as the body yarn.

It is also known to knit fabric of wool yarn and to then full this fabric to make it substantially ravelproof. This type of fabric has been used in forming the cover material for tennis balls and is illustrated in U.S. Pat. No. 2,018,559.

U.S. Pat. No. 4,255,819 discloses an athletic type sock knit of non-feltable body yarn and with a feltable wool yarn being knit with the body yarn in the heel, sole and toe area. The sock is then subjected to a fulling treatment so that the wool fibers are felted to make the heel, sole and toe dense. The fulling treatment also limits the stretchability of the heel, sole and toe portions of the sock so that these portions of the sock do not provide a comfortable fit on the foot of the wearer. Additionally, the fulling operation adds a separate step to the manufacture of the sock and thereby increases the cost of producing the sock.

SUMMARY OF THE INVENTION

With the foregoing in mind, it is an object of the present invention to provide a cushion foot sock in which a heavy wool yarn is knit with the body yarn and the heavy wool yarn is exposed on the outer surface of the high-splice area, heel, sole and toe so that these areas have good stretchability to provide a comfortable fit and a soft fuzzy appearance. The heavy wool yarn also forms inwardly extending terry loops in these same portions of the sock to provide a heavy cushion and good moisture absorbency to the high-splice area, heel, sole and toe.

In accordance with the present invention, the cushion foot sock is knit throughout with synthetic body yarns and an elastic yarn is incorporated in spaced-apart wales and floats inside of multiple wales in both the leg and instep to form mock ribs in the leg and instep of the sock. The elastic yarn is incorporated in alternate single wales of alternate single courses and in intervening single wales of intervening single courses of the high-splice area, heel, sole and toe while the heavy wool yarn is plated to the outside of the fabric in the high-splice area, heel, sole and toe. The elastic yarn in the leg and instep helps to support the sock while the elastic yarn in the sole helps to maintain the "cushion foot" in position against the foot of the wearer.

It is preferred that the body yarn include a synthetic bulk yarn and a synthetic stretch yarn knit in plated relationship with each other. The elastic yarn preferably includes an elastomeric core with two wrapping covers applied thereto. It is also preferred that the synthetic bulk yarn be about three to five times as large as the synthetic stretch yarn, and that the wool yarn be larger than the total size of both the bulk yarn and the stretch yarn forming the body yarn.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
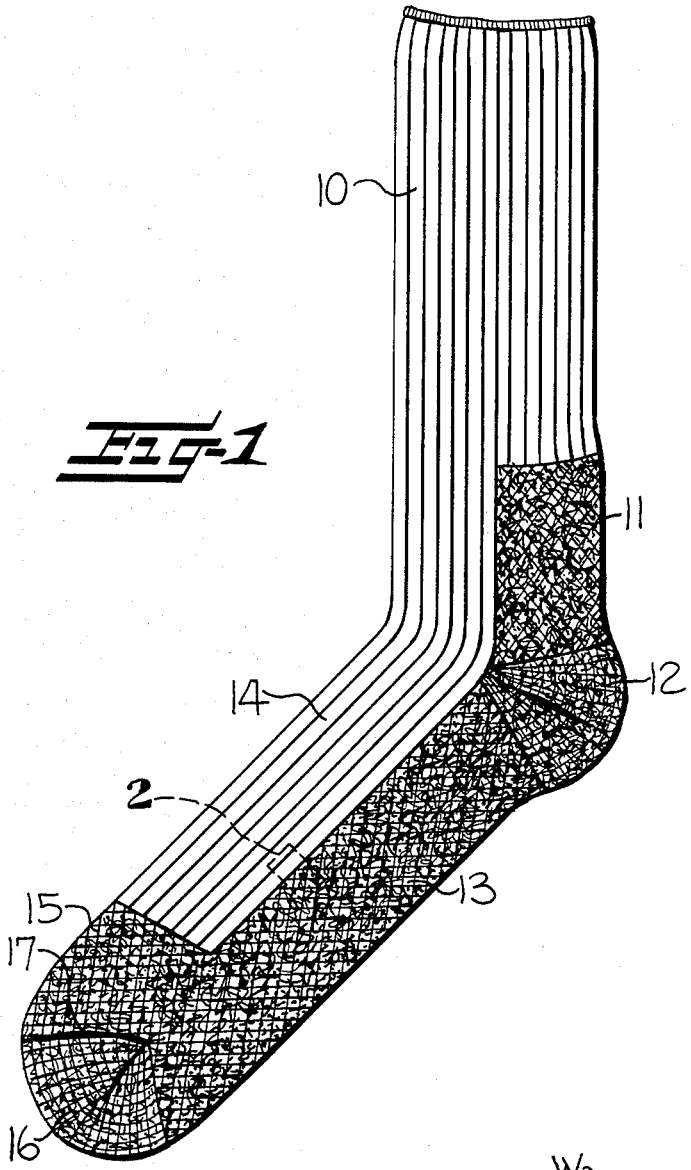
FIG. 1 is a side elevational view of the cushion foot sock of the present invention.

The present sock includes a leg 10 with a high-splice area 11 extending above a heel pocket 12. The foot of the sock also includes a sole portion 13, an instep portion 14, a ring-toe area 15 and a toe pocket 16. The normally open toe end of the sock is closed by a closure seam 17. The leg 10 and instep 14 include successive courses, as indicated at C-1 through C-4 in FIG. 2, forming stitch loops in adjacent needle wales W-1 through W-10.

A body yarn, illustrated as being formed of a synthetic bulked yarn O, and a plated synthetic stretch yarn N, is knit in successive needle wales of successive courses throughout the entire sock. An elastic yarn E is incorporated in spaced-apart wales and floats inside of multiple wales therebetween to form a mock rib in the leg 10 and instep 14. As illustrated in the left-hand portion of FIG. 2, the elastic yarn E is knit with the body yarn in spaced-apart wales, such as wales W-1 and W-5 and is floated inside of the wales W-2 through W-4 in what is known as a three-by-one manner to form mock ribs in the leg 10 and instep 14.

Figure 3:
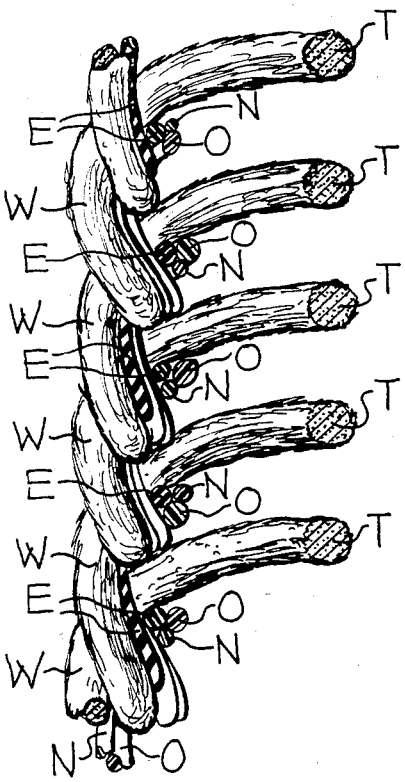
FIG. 3 is an enlarged vertical sectional view taken substantially along the line 3—3 in FIG. 2 and illustrating the manner in which the yarns are plated together and the wool yarn forms inwardly extending terry loops.

In the high-splice area 11, the heel 12, the sole 13, the ring-toe 15, and the toe 16, heavy wool yarn W is knit in plated relationship with the body yarn so that the wool yarn is exposed on the outside of these portions of the sock. The wool yarn W is knit over the nibs of the sinkers in the high-splice area 11, the heel 12, the sole 13, the ring-toe 15, and the toe 16 to form inwardly extending terry loops, indicated at T in FIGS. 2 and 3. The inwardly extending terry loops provide a "cushion foot" in the sock and aid in providing good moisture absorbency to the foot portion of the sock. As illustrated in the right-hand portion of FIG. 2, the heavy wool yarn W provides a soft and fuzzy appearance on the outer surface of these portions of the sock.

In the high-splice area 11, the sole 13, and the ring-toe 15, the elastic yarn E is knit in plated relationship with the body yarn and the wool yarn W in alternate single wales, such as wales W-7 and W-9 of alternate single courses, such as courses C-1 and C-3, and floats across intervening single wales, as shown in wales W-6, W-8 and W-10. In these same areas, the elastic yarn E is knit in intervening single wales, such as wales W-6, W-8, and W-10, of intervening single courses, such as courses C-2 and C-4, and floats across alternate single wales, as shown in wales W-7 and W-9. The elastic yarn E is thus floated across single staggered or offset wales from course to course.

The heel pocket 12 and toe pocket 16 are knit in the usual manner with reciprocation of the needle cylinder to successively form a gradually decreasing partial course fashioned segment and a gradually increasing partial course fashioned segment joined along gore or suture lines. In the heel pocket 12 and toe pocket 16, the body yarn, including the bulked yarn O and the stretch yarn N is knit with the wool yarn W and the wool yarn is plated to the outside.

As a specific but nonlimiting example, it has been found that a satisfactory cushion foot sock can be produced by knitting the portion of the leg 10 down to the high-splice area 11 of a body yarn comprising a single end of size 12 Orlon yarn O in plated relationship with a 2/70/17 stretch nylon yarn N. The size 12 Orlon yarn O is equivalent to 664 denier while the stretch nylon yarn N has a total denier of 140 so that the bulk yarn O is 4.75 times as large as the stretch yarn N. The elastic yarn E is a 240 denier Lycra elastic yarn having two covers wrapped thereabout. The elastic yarn E is knit and floated with the body yarn in a three-by-one manner, as illustrated in the left-hand portion of FIG. 2. The knitting and floating of the elastic yarn E in the leg 10 and instep 14 forms mock ribs in these areas.

At the upper end of the high-splice area 11, the size of the bulk yarn O is reduced to a single end of size 16 Orlon (equivalent to 498 denier) so that the hooks of the needles are not overloaded when the wool yarn W is introduced in the high-splice area 11. The stretch nylon yarn N is still knit in plated relationship with the Orlon yarn O throughout the remainder of the sock. In these remaining areas of the sock, the Orlon yarn O is 3.56 times as large as the stretch nylon yarn N.

Figure 2:
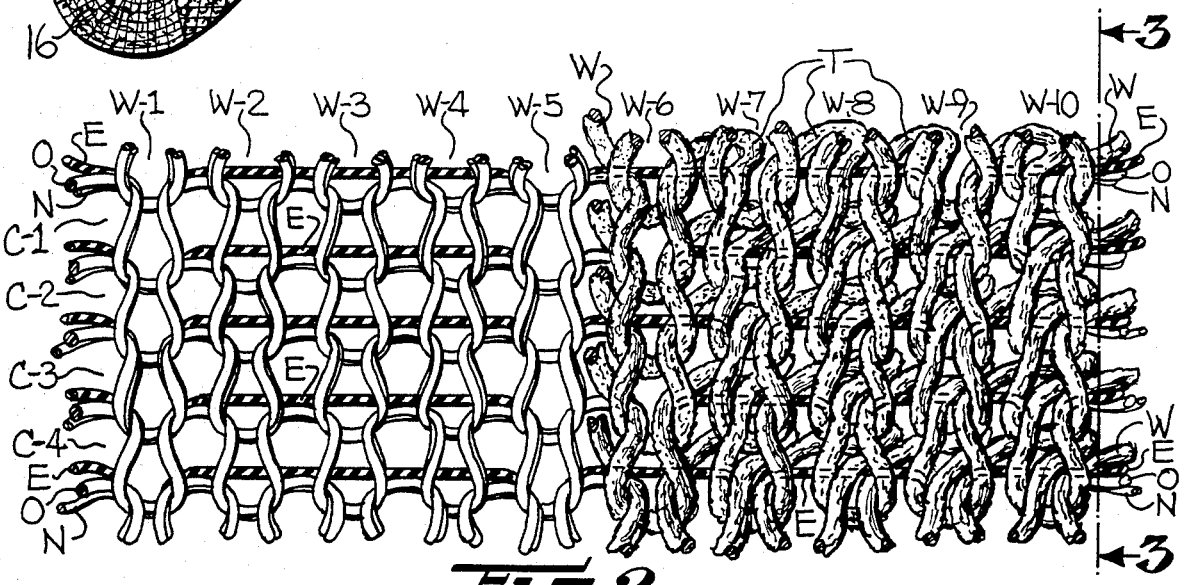
FIG. 2 is a greatly enlarged fragmentary view of the stitch structure of the fabric at the juncture of the mock rib instep and the sole portion, including the area enclosed by the dotted rectangle 2 in FIG. 1.

The body yarn is also knit with the elastic yarn E in the high-splice area 11, sole 13 and ring-toe area 15 except that the elastic yarn is knit and floated in a one-by-one manner and the wales in which the elastic yarn is floated are staggered in successive courses, as shown in the right-hand portion of FIG. 2, to provide somewhat of a diamond pattern appearance thereto. In these areas, as well as in the heel 12 and toe 16, three ends of 24 single wool yarn W is knit in plated relationship with the body yarn. The wool yarn W is equivalent to a 996 total denier so that it is larger than the total denier of the body yarn (804 denier in the leg 10, and 638 denier in the remainder of the sock). In the high-splice area 11 and the sole 13, the wool yarn W is introduced at one side and removed and clipped at the other side of the foot, thereby producing free cut ends, as illustrated between wales W-5 and W-6 in FIG. 2.

In order to provide the desired fuzzy appearance and soft cushion in the high-splice area 11, heel 12, sole 13, ring-toe 15, and toe 16, it has been found to be necessary to use a wool yarn in these areas which is larger than the total size of the body yarn, including both the bulk yarn O and the plated stretch yarn N. Also, it has been found that the bulk yarn O should be about three to five times as large as the plated stretch yarn N, in order to obtain the desired bulky appearance in the leg 10 and instep 14.

As has been noted in this specific example, the Orlon yarn O is more than three times as large as the stretch nylon N while the total denier of the body yarn is somewhat smaller than the total denier of the three ends of wool yarn W. The knitting and floating of the elastic yarn in a three-by-one manner in the leg 10 and instep 14 thus provides an attractive mock-rib appearance and aids in supporting the sock on the foot while the knitting and floating of the elastic yarn in a staggered one-by-one manner in the high-splice area 11, sole 13 and ring-toe area 15 provides firm support for the lower portion of the foot and provides a snug fit so that the inwardly extending terry loops T remain in engagement with the lower portion of the foot of the wearer.

In the drawings and specification there has been set forth the best mode presently contemplated for the practice of the present invention, and although specific terms are employed, they are used in a generic and descriptive sense only, and not for purposes of limitation, the scope of the invention being defined in the claims.

That which is claimed is:

1. An improved cushion foot sock including a leg, and a foot with a heel, an instep, a sole, and a toe knit of a body yarn, the improvement comprising an elastic yarn incorporated in spaced-apart wales and floating inside of multiple wales of successive courses of said leg and said instep and forming mock ribs therein, said elastic yarn being incorporated in every other wale in said sole to provide stretchability and to maintain said sole in close engagement with the foot of the wearer, and wool yarn knit in plated relationship with said body yarn in said heel, sole and toe so that said wool yarn is exposed on the outside of said heel, sole and toe to provide a soft and fuzzy appearance thereto, said wool yarn forming inwardly extending terry loops in said heel, sole and toe to provide a soft cushion and good moisture characteristics thereto.

2. A sock according to claim 1 including a high-splice area extending above said heel, and a ring-toe area adjacent said toe, and wherein said wool and body yarns are knit in plated relationship in said high-splice and said ring-toe areas.

3. A sock according to claim 2 wherein said wool yarn forms inwardly extending terry loops in said high-splice area, heel, sole, ring-toe, and toe.

4. A sock according to claim 1 wherein said body yarn comprises a synthetic bulked yarn and a synthetic stretch yarn knit in plated relationship with each other, and wherein said bulked yarn is at least three times as large as said stretch yarn.

5. A sock according to claim 1 wherein said elastic yarn is incorporated in alternate single wales of alternate single courses in said sole and in intervening single wales of intervening single courses in said sole.

6. A sock according to claim 1 wherein said wool yarn is larger than said body yarn.

7. An improved cushion foot sock including a leg, and a foot with a heel, high-splice area extending above said heel, an instep, a sole, a toe, and a ring-toe area adjacent said toe, said sock being knit throughout of a body yarn comprising a synthetic bulked yarn and a synthetic stretch yarn knit in plated relationship with each other, the improvement comprising an elastic yarn incorporated in spaced-apart wales and floating inside of multiple wales of successive courses of said leg and said instep and forming mock ribs therein, said elastic yarn being incorporated in every other wale in said sole to provide stretchability and to maintain said sole in close engagement with the foot of the wearer, and wool yarn knit in plated relationship in said body yarn in said high-splice area, said heel, said sole, said toe, and said ring-toe area so that said wool yarn is exposed on the outside of these areas to provide a soft and fuzzy appearance thereto, said wool yarn forming inwardly extending terry loops in said high-splice area, heel, sole, toe and ring-toe area to provide a soft cushion and good moisture characteristics thereto.

8. A sock according to claim 7 wherein said elastic yarn is incorporated in alternate single wales of alternate single courses and in intervening single wales of intervening single courses in said high-splice area, said sole, said toe, and said ring-toe area.

9. A sock according to claim 7 wherein said bulked yarn of said body yarn is at least three times as large as said stretch yarn of said body yarn.

10. A sock according to claim 9 wherein said wool yarn is larger than said body yarn.

* * * * *